US005462223A

United States Patent [19]

Focke et al.

[11] Patent Number: 5,462,223

[45] Date of Patent: Oct. 31, 1995

[54] PROCESS FOR COATING GLUE SPOT ROWS AND STRIPS ONTO LONGITUDINALLY EXTENDING BLANKS FOR HINGE-LID PACKS AND BLANKS PRODUCED THEREBY

[75] Inventors: Heinz Focke; Michael Schlenker, both of Verden, Germany

[73] Assignee: Focke & Co. (GmbH & Co.), Verden, Germany

[21] Appl. No.: 162,262

[22] Filed: Dec. 7, 1993

[30] Foreign Application Priority Data

Dec. 8, 1992 [DE] Germany ..... 42 41 176.9

[51] Int. Cl.[6] ..... B05D 5/10; B65D 43/16

[52] U.S. Cl. ..... 229/160.1; 427/207.1; 427/288; 493/911

[58] Field of Search ..... 427/207.1, 208.2, 427/208.6, 288; 156/226, 227, 291; 493/128, 130, 131, 150, 151, 333, 910, 811; 206/273; 229/160.1

[56] References Cited

U.S. PATENT DOCUMENTS

| | | | |
|---|---|---|---|
| 2,296,079 | 9/1942 | Anderson . | |
| 4,314,643 | 2/1982 | Forbes, Jr. | 206/626 |
| 4,487,596 | 12/1984 | Livens et al. | 493/911 |
| 4,708,704 | 11/1987 | Focke et al. | 493/151 |
| 4,742,955 | 5/1988 | Focke et al. | 229/123 |
| 4,949,841 | 8/1990 | Focke et al. | 206/254 |
| 5,024,709 | 6/1991 | Faulkner, III et al. | 156/69 |
| 5,092,516 | 3/1992 | Kastanek | 493/911 |

FOREIGN PATENT DOCUMENTS

| | | |
|---|---|---|
| 1183351 | 12/1964 | Germany . |
| 1914942 | 11/1969 | Germany . |
| 2435036 | 1/1976 | Germany . |
| 2834441 | 2/1979 | Germany . |
| 8200355 | 9/1982 | Germany . |
| 3108089 | 1/1987 | Germany . |
| 3738102 | 5/1989 | Germany . |
| 4032870 | 4/1992 | Germany . |
| 1325802 | 8/1973 | United Kingdom . |

*Primary Examiner*—Terry J. Owens

*Attorney, Agent, or Firm*—Sughrue, Mion, Zinn, Macpeak & Seas

[57] ABSTRACT

Blanks (10) for hinge-lid packs are provided with glue in the form of glue spots (29*a* to 29*i*). A plurality of rows (33 to 36) of the glue spots are distributed over the blank (10) in such a manner that the pack collar (84) and the inner wrapping (82) are sufficiently fixed, and that a lid inner tab (22) is permanently connected to a lid front wall (20). The glue spots (29*a* to 29*i*) are applied by a gluing unit (37) which can be removed as a unit from the packaging machine and which is connected to a glue container via a main glue line (56).

3 Claims, 5 Drawing Sheets

PROCESS FOR COATING GLUE SPOT ROWS AND STRIPS ONTO LONGITUDINALLY EXTENDING BLANKS FOR HINGE-LID PACKS AND BLANKS PRODUCED THEREBY

BACKGROUND OF THE INVENTION

The invention relates to a process for the coating of glue onto blanks for the production of hinge-lid packs for receiving cigarette groups wrapped in an inner blank, the blank having regions limited by folding lines, for the formation of a pack part and of a lid connected to the latter in an articulated manner, the pack part consisting of a front wall, a rear wall, side tabs for forming two-layer sidewalls, a bottom wall and, if appropriate, bottom corner tabs, and the lid consisting of a lid front wall, lid rear wall, lid side tabs, lid top wall and, if appropriate, a lid inner tab fastened to the inside of the lid front wall, and furthermore a collar having a collar front wall and collar side tabs being connected to the front wall and folding tabs to one another by means of glue.

Hinge-lid packs are a form of packaging used throughout the world for cigarettes and other material to be packaged. The construction of a hinge-lid pack makes it necessary for folding tabs to be connected to one another by adhesive bonding. Furthermore, separate blanks are to be fixed within the hinge-lid pack by means of glue, namely especially the collar and the inner wrapping of the cigarette group or the like.

The glue has hitherto predominantly been coated onto the blank or onto the partially folded hinge-lid pack by glue-coating members, in such a way that strip-shaped or large-area glue places are formed.

SUMMARY OF THE INVENTION

The object on which the invention is based is to propose measures, by means of which an exact transfer of glue onto blanks or partially folded packs becomes possible at higher outputs and conveying speeds.

To achieve this object, the process according to the invention is characterized by the following features:

a) the glue is coated onto the blank to form glue spots, b) during the transport of the blanks, the glue spots are coated onto the blank from above in at least three parallel rows, namely spot row, extending in the direction of transport, c) at least one respective spot row is arranged in the region of the inner side tabs and of the front wall and/or rear wall for the purpose of fixing the inner wrapping of the cigarette group.

According to the invention, the glue spots can be applied by glue nozzles of fixed location, which, as a result of an exact control, transfer glue intermittently onto the blanks moved past the glue nozzles. The glue nozzles are designed for very high numbers of cycles, so that, even at a high working speed of the packaging machine and correspondingly high conveying speeds for the blanks, exact glue patterns can be transferred.

Parallel rows extending in the longidutinal direction of the blank and each consisting of a plurality of glue spots succeeding one another at a distance are formed. According to the invention, two parallel spot rows of glue spots are formed in the region of a middle strip of the blank essentially formed from a front wall, bottom wall, rear wall, lid front wall, lid top wall and lid rear wall. Preferably, two rows, each with two glue spots, are applied to the inside of the front wall, in order to fix the collar front wall, and two spot rows, likewise with two glue spots, are applied at a distance from these in order to attach the inner blank to the front wall. Corresponding glue patterns for fixing the inner wrapping are located in the region of the rear wall. Furthermore, the glue-coating for fastening the lid inner tab to the lid front wall is designed in a special way.

The apparatus according to the invention for applying the glue spots to the blanks consists of a glueing unit having a plurality of glue nozzles, corresponding to the number of spot rows, and of a common central glue container. The glueing unit is mounted removably as a unit on the packaging machine, in such a way that it can easily be removed for purposes of cleaning and repair. Details of the invention relate to the design of the glueing unit.

A further particular feature of the invention relates to the design of the glue nozzles, such that the risk of soiling is reduced.

Particulars of the hinge-lid pack according to the invention and of the apparatus for applying the glue spots are explained in more detail below by means of the drawings. In these:

DESCRIPTION OF PREFERRED EMBODIMENTS

Figure 1:
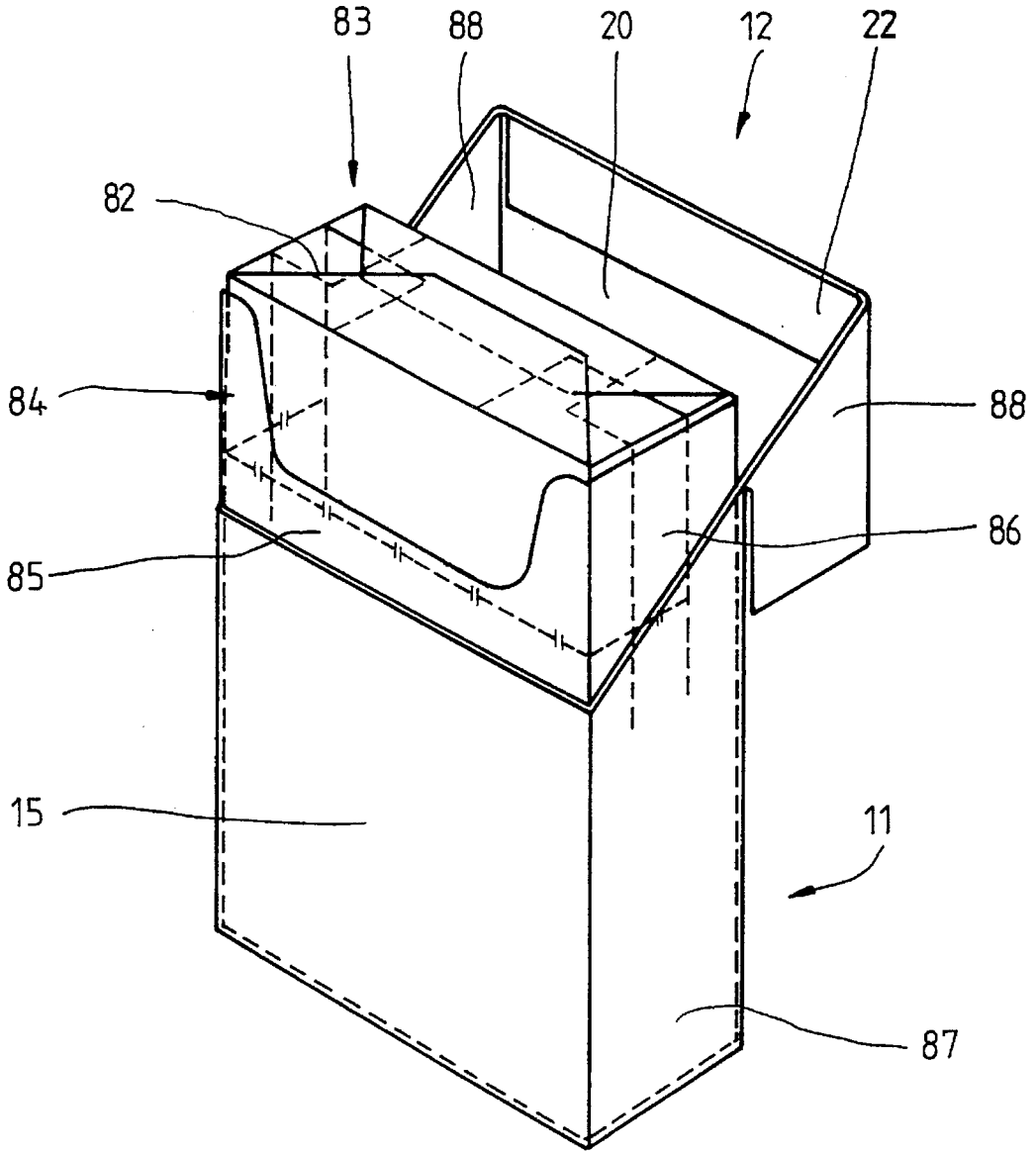
FIG. 1 shows a perspective representation of a hinge-lid pack.
Figure 2:
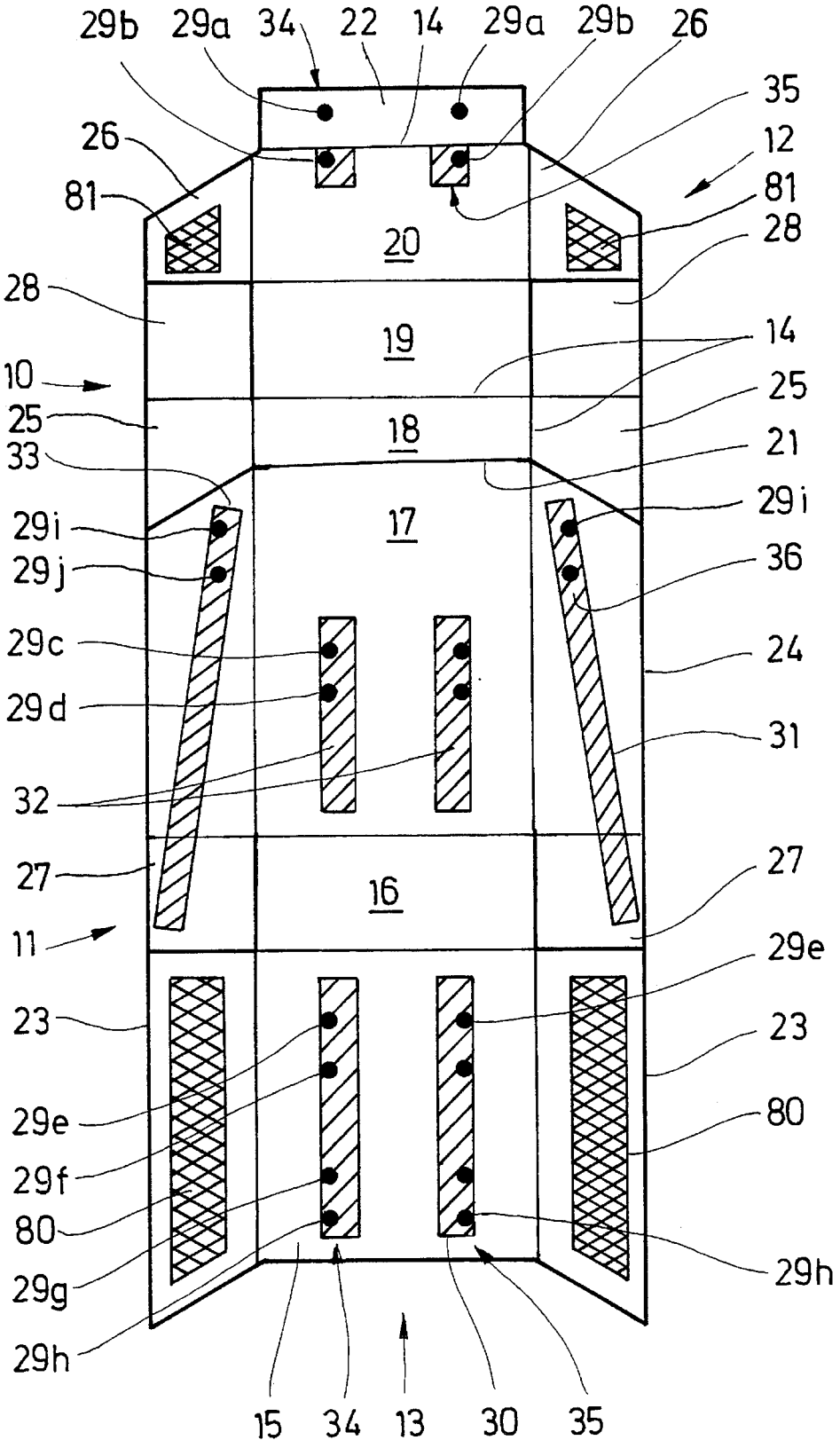
FIG. 2 shows a spread-out blank for a hinge-lid pack with a glue pattern.

FIG. 2 shows a conventionally designed blank 10 consisting of thin cardboard for hinge-lid packs. A pack of this type, for example for cigarettes, is shown in FIG. 1 in the opening position in the perspective representation. The hinge-lid pack consists of a pack part 11 and of a lid 12. In the cigarette pack, a cigarette group is wrapped in an inner wrapping 82 consisting of tin foil or paper, to form a cigarette block 83 filling the interior of the hinge-lid pack. This type of pack includes, furthermore, a collar 84 having a collar front wall 85 and collar side tabs 86. The collar 84 is anchored in the pack part 11 of the hinge-lid pack by adhesive bonding.

The blank 10 forms an elongate middle strip 13. This is subdivided by longitudinally and transversely directed folding lines 14 into areas for a front wall 15, bottom wall 16, rear wall 17, lid rear wall 18, lid top wall 19 and lid front wall 20. The rear wall 17 and lid rear wall 18 are divided from one another by a line of articulation 21. In this exemplary embodiment, a lid inner tab 22 adjoins the free side of the lid front wall 20. In the finished hinge-lid pack, this lid inner tab 22 is folded against the inside of the lid front wall 20.

On both sides of the middle strip 13 are located further folding tabs, namely outer side tabs 23 and inner side tabs 24, for forming double-layer sidewalls 87 of the pack. In a similar way to this, inner lid side tabs 25 are located in the region of the lid rear wall 18 and outer lid side tabs 26 are located in the region of the lid front wall 20, in each case for the purpose of forming lid sidewalls 88. Both the inner side tabs 24 and the lid side tabs 25 are provided with bottom corner tabs 27 and lid corner tabs 28 respectively. In the finished hinge-lid pack, these folding tabs bear against the bottom wall 16 and lid top wall 19 respectively.

FIG. 2 is provided with hitherto conventional glue markings and, in addition, with the new glue pattern consisting of glue spots 29. The strip-shaped glue patterns single-hatched in FIG. 2 show the hitherto conventional glue coating of a hinge-lid pack, glue strips 30, 31 and 32 serving for fixing the inner wrapping and partially for glueing the collar (glue strips 30 and 31). The cross-hatched glue strips 80 and 81 also serve for connecting the side tabs 23 and 24 or the lid side tabs 25 and 26 to one another respectively in the new hinge-lid pack or in the new type of glue coating.

In the new version (according to the invention) of the hinge-lid pack, the glue strips 30, 31 and 32 are replaced by spot-like glue places, namely by the glue spots 29. These are arranged in rows which extend in the longitudinal direction of the blank 10. In the present exemplary embodiment, glue spots are distributed in four spot rows 33, 34, 35 and 36. Each spot row 33 to 36 consists of a plurality of glue spots 29 arranged at a distance from one another. In the present exemplary embodiment, two glue spots 29 arranged at a predetermined fixed distance from one another always form a respective functionally determined glueing region. The two glue spots **29*i*, 29*j* of the spot row 33 and of the spot row 36, in each case in the region of the inner side tabs 24, serve for glueing part of the collar 84, namely the collar side tabs 86 glued, here, to the inside of the pack part 11. The bottom corner tabs 27 can likewise have glue spots which are located in the spot rows 33 and 36 (not shown). These glue spots serve for fixing the inner wrapping 82. The spot rows 34 and 35 running at a distance from one another in the region of the middle strip 13 are assigned to a plurality of regions. For the adhesive bonding of the lid inner tab 22, two glue spots 29*a*, 29*b* for each spot row 34, 35 are provided. One glue spot 29*a* is located in the region of the lid inner tab 22, and the other glue spot 29*b* is located in the region of the lid front wall 20. However, the glue spots 29*a*, 29*b* are applied in relation to a transversely directed folding line 14 in such a way that, in the folded lid inner tab 22, there is no overlap of the glue spots 29*a*, 29*b***.

Two respective glue spots **29*c*, 29*d* in each spot row 34, 35 are located approximately in the middle region of the rear wall 17. These glue spots 29*c*, 29*d* serve for fixing the inner wrapping 82**.

The same purpose is served by two respective glue spots **29*e* and 29*f* facing the bottom wall 16 and located in the region of the front wall 15. The latter carries two further glue spots 29*g* and 29*h*, each facing a free edge of the front wall 15. The glue spots 29*g* and 29*h* serve for the adhesive bonding of the collar front wall 85**.

Figure 3:
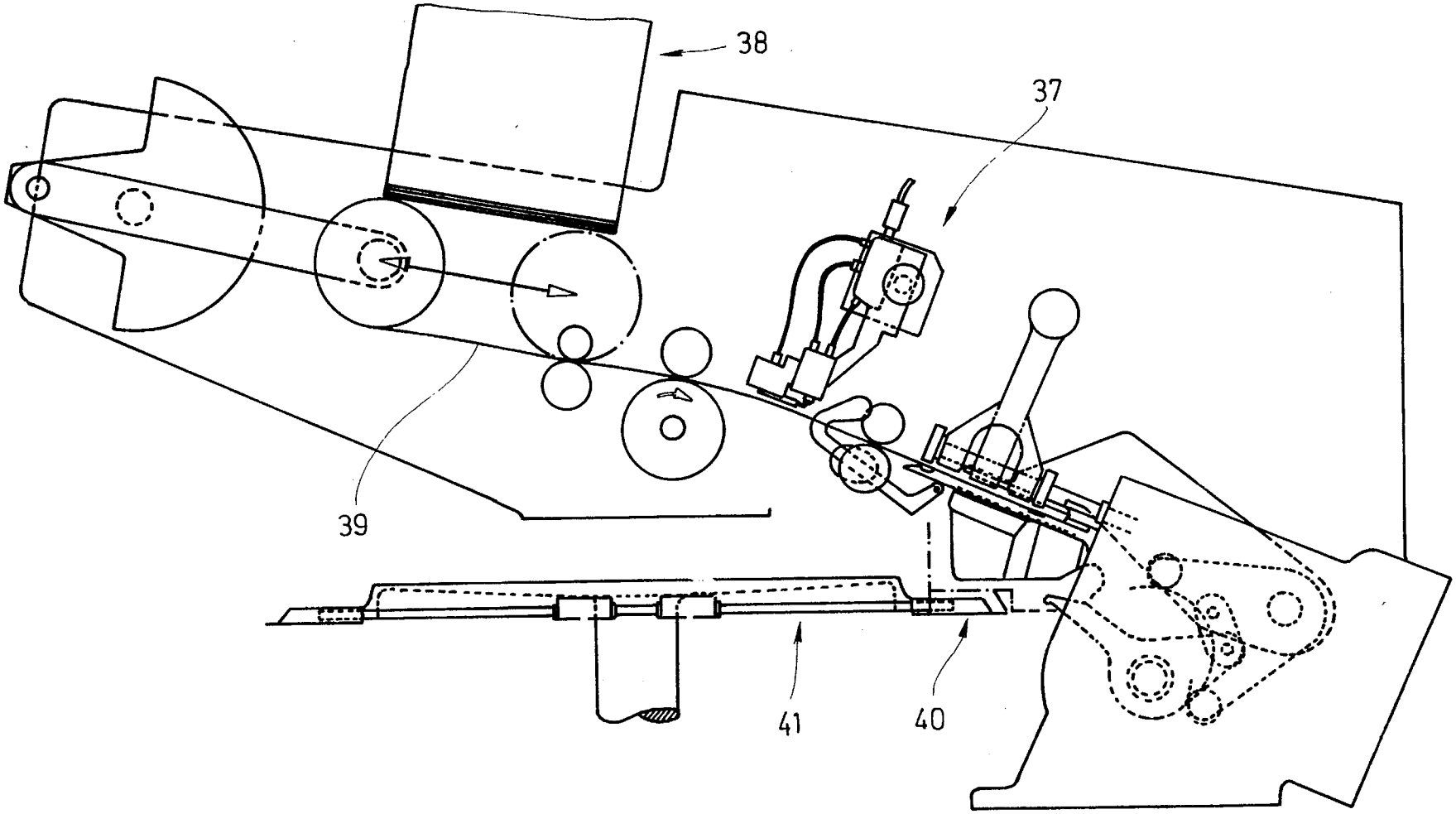
FIG. 3 shows part of a packaging machine with a glueing unit for applying glue spots to blanks.
Figure 5:
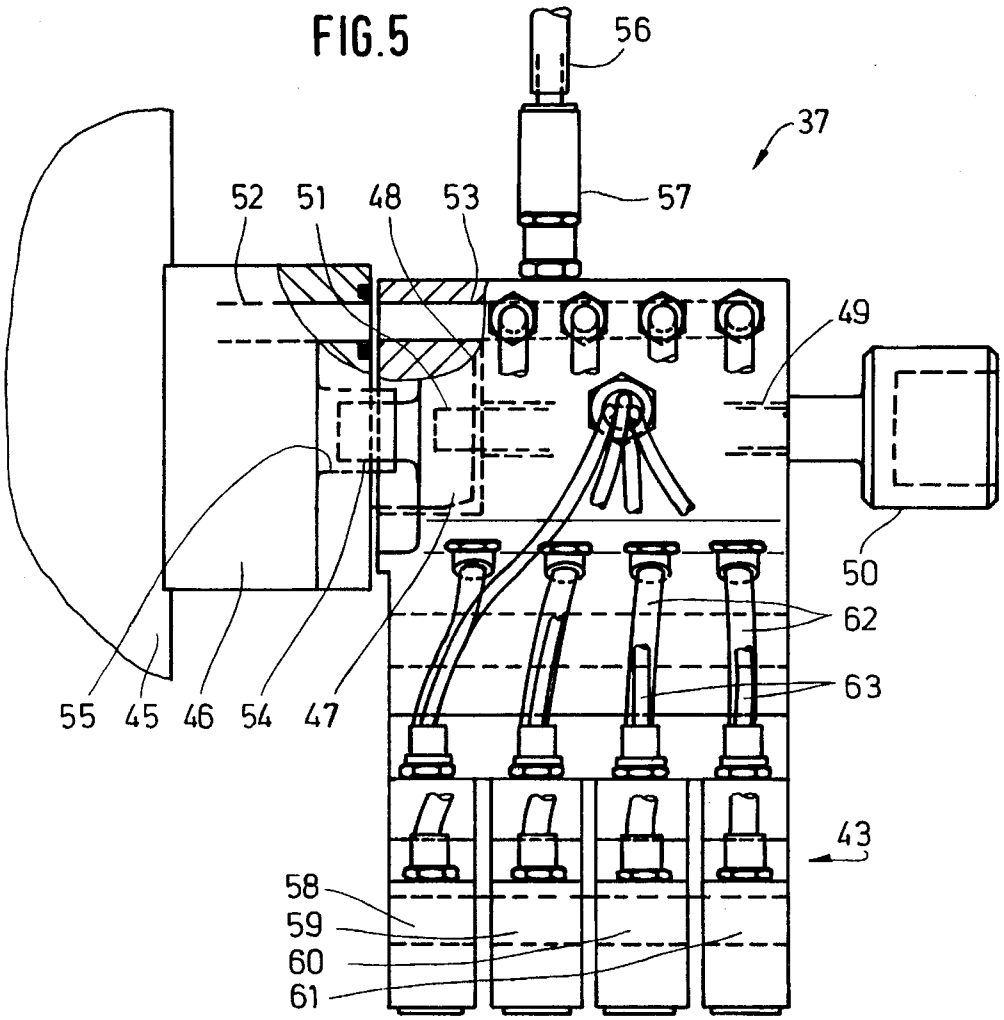
FIG. 5 shows a front view of the glueing unit offset at 90° to FIG. 4.
Figure 4:
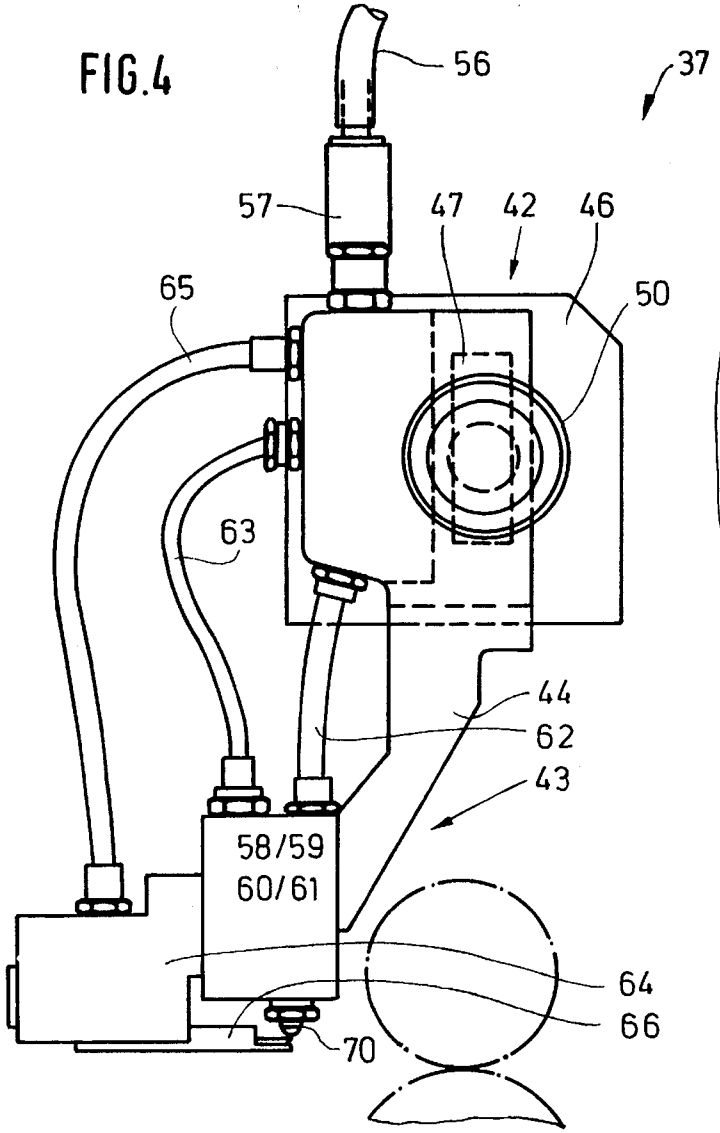
FIG. 4 shows a diagrammatic side view of the glueing unit as a detail.

The glue spots **29*a*, 29*b*, etc., designed and distributed in the foregoing way, are applied in the longitudinal direction, during the transport of the blanks 10, by means of a glueing unit 37. In the present exemplary embodiment (FIG. 3), this is part of a packaging machine for the production of hinge-lid packs, such as is illustrated and described by way of example in U.S. Pat. No. 4,084,393. The blanks 10 are extracted from a blank magazine 38 and transported along an obliquely descending blank track 39. Also located in the region of this blank track 39 is the glueing unit 37 which coats the glue spots 29*a*, etc. onto the upward-facing side of the blanks 10. These then pass into a pushing-in station 40, in which the blanks 10 are introduced from above into pockets of a plate-shaped folding turret 41**.

The glueing unit 37 is mounted as a unit in an easily removable manner on the frame of the packaging machine. In the present exemplary embodiment, the glueing unit 37 consists of two main parts, namely a supply unit 42 and a nozzle unit 43. The two abovementioned parts are connected to one another by means of a supporting piece 44.

The supply unit 42 is attached releasably with one side to a carrier 45 of the machine frame. For this purpose, a block-like holder 46 is mounted on the carrier 45 and allows a positive attachment of the supply unit 42. For this purpose, a projection 47 is formed on the holder 46 and penetrates positively into a recess 48 of the supply unit 42. A threaded bolt 49 guided through the supply unit 42 and having an exposed handwheel 50 penetrates with one end into a threaded hole 51 of the projection 47. When the threaded bolt 49 is tightened by turning it, the supply unit 42 and therefore the entire glueing unit 37 are thus fastened releasably to the machine frame.

The entire supply of the glueing unit 37, with the exception of the glue feed, is carried out via the holder 46. Compressed air is fed to the supply unit 42, specifically to a distributor line 53, via a compressed-air line 52. The current supply takes place via an electrical plug 54 which penetrates into a socket 55 of the holder 46.

The supply unit 42 is connected to a glue stock or glue container via a central main glue line 56. The connection of the main glue line 56 is made via a specially designed coupling 57. This is equipped with an automatic closing member which blocks the main glue line 56 when the latter is separated from the glueing unit 37 by means of the coupling 57. Thus, after the release of the threaded bolt 49, the entire glueing unit can be removed from the packaging machine, without the central glue container thereby being affected.

In the present exemplary embodiment, the nozzle unit 43 consists of four glue nozzles 58, 59, 60, 61 arranged at equal distances from one another. The glue nozzles 58 to 61 extend at a short distance above the path of movement of the blanks 10, that is to say above the blank track 39. Each glue nozzle 58 to 61 serves for transferring the glue spots 29 for an associated spot row 33 to 36.

The glue nozzles 58 to 61 are supplied with glue from the supply unit 42. For this purpose, a glue line 62 leads from the supply unit 42 to each glue nozzle 58 to 61.

Furthermore, individual electrical lines 63 lead from the supply unit 42 to each glue nozzle 58 to 61. For supplying with compressed air, each glue nozzle 58 to 61 is assigned a compressed-air unit 64. This is seated laterally on a housing of each of the glue nozzles 58 to 61. An air line 65 leads respectively from the supply unit 42 to each glue nozzle 58 to 61 or to the associated compressed-air unit 64.

Each glue nozzle 58 to 61 can be controlled individually. Exact glue patterns are thereby possible. The compressed air causes a sufficient glue quantity to be dispensed within the shortest possible opening phases of the glue nozzle 58 to 61. After each work cycle, each glue nozzle 58 to 61 is closed by means of a slide 66 underneath the mouth of the glue nozzles 58 to 61. The slide 66 can be controlled by members which are arranged within the compressed-air unit 64. The slide 66 is actuated, here, by means of compressed air.

Figure 6:
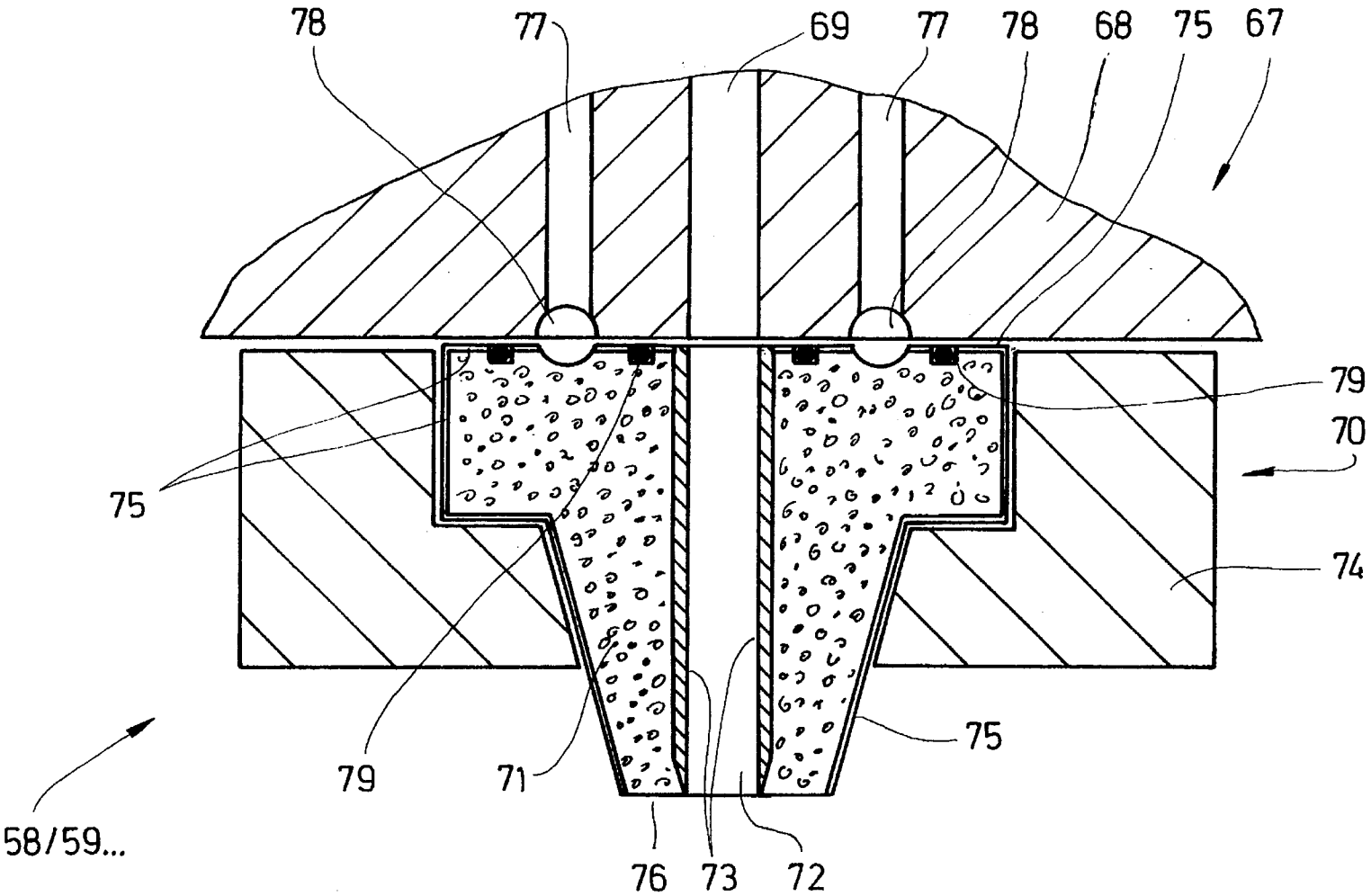
FIG. 6 shows a detail, namely a particular feature of a glue nozzle in vertial and in longitudinal section, greatly enlarged.

The lower region of the glue nozzles 58 to 61 is designed in a special way, namely as a nozzle head 67 (FIG. 6). A nozzle housing 68 is provided with a central nozzle bore 69. Attached releasably to the nozzle housing 68 at the bottom or on the outlet side is a mouth head 70. This consists of a head piece 71 with a bore end 72 extending in a continuation of the nozzle bore 69. The head piece 71 consists of an air-permeable material, for example of porous (permeable) plastic. The nozzle bore 69 or the bore end 72 is surrounded, in the region of the mouth head 70, by a closed cylindrical casing 73, especially made of stainless steel. The head piece 71, frustoconically configured in the lower or outer part, is fixed to the nozzle housing 68 by means of a clamping ring 74. Opposite the clamping ring 74 and in an end region (nozzle tip) projecting beyond the clamping ring 74, the air-permeable head piece is provided on the outside with an air-tight jacket 75. A lower end face or front face 76 is free for the passage of air.

The head piece 71 is supplied with compressed air, in the present case via compressed-air channels 77 on both sides of the nozzle bore 69. The compressed-air channels 77 terminate in an annular channel 78, the part cross-section of which extends all-round in the region of the head piece 71. The compressed air fed by the compressed-air channels 77 is therefore distributed on the inlet side of the head piece 71. The compressed air flows out at the bottom in the region of the front face 76. The purpose of this measure is to prevent residues of glue in the region of the front face 76. The glue nozzles 58 to 61 are thereby always free of glue residues at the mouths. The compressed air is controlled intermittently according to the actuation of the glue nozzles 58 to 61. The annular conduit 78 is sealed off by means of sealing rings 79.

We claim:

1. A process for coating glue onto longitudinally extending blanks (10) for producing hinge-lid packs each of which is adapted to receive a cigarette group wrapped in an inner wrapping (82) to form a cigarette block (83); each blank (10) having regions limited by folding lines (14) for formation of a pack including a pack part (11) and of a lid (12) flexibly connected thereto: the pack part (11 ) having a pack front wall (15), a pack rear wall (17), pack inner and outer side tabs (23, 24) that form two-layer pack side walls (87), and a pack bottom wall (16); the lid (12) consisting of a lid front wall (20), a lid top wall (19), and a lid inner tab (22) fastened to the inside of the lid front wall (20); each pack also including a collar (84), consisting of a collar front wall (85) and of collar side tabs (86), which is connected to the pack front wall (15) and to the pack inner side tabs (24) by glue; said process comprising coating glue onto each blank (10) to form a plurality of glue spots (**29*a*–29*i*) and a plurality of glue strips (80, 81**), wherein:

a) the glue spots (**29*a*–29*i*) and the glue strips (80, 81) are coated onto each blank (1**) during transport of the blanks in the longitudinal direction of each blank;

b) the glue spots (**29*a*–29*i*), are coated from glue nozzles above the blanks onto each blank in four parallel spot rows (33, 34, 35, 36) which extend in the longitudinal direction of the blank (10**), and which are transversely spaced apart, so that longitudinally spaced pairs of longitudinally adjacent glue spots respectively define several glue areas;

c) a first pair (34, 35) of said four spot rows is on a middle strip (13) of the blank, said middle strip consisting of the pack front wall (15), the pack bottom wall (16), the pack rear wall (17), the lid rear wall (18), the lid top wall (19), the lid front wall (20) and the lid inner tab (22), in such a way that two pairs of longitudinally adjacent glue spots (**29*c*, 29*d*) coated on the pack rear wall (17), and two pairs of longitudinally adjacent glue spots (29*e*, 29*f*) coated on the pack front wall (15) and facing the pack bottom wall (16), define first and second glue areas, respectively, for fixing the inner wrapping (82) of the cigarette block (83) to the pack, and also in such a way that two pairs of longitudinally spaced glue spots (29*g*, 29*h*), coated on the front wall (15) and facing a free edge thereof, create third and fourth glue areas, respectively, for fixing the collar front wall (85) to the pack part (11), and such that two pairs of longitudinally adjacent glue spots (29*a*, 29*b*), coated on the lid inner tab (22) and on the lid front wall (20), create fifth and sixth glue areas, respectively, for fixing the lid inner tab (22) to the lid front wall (20**);

d) a second pair (33, 36) of said four spot rows is on the inner pack side tabs (24), respectively, the inner side tabs (24) being located on transversely opposite sides of the middle strip (13), in such a way that two pairs of longitudinally adjacent glue spots (**29*i*, 29*j*), coated on the inner side tabs (24), create seventh and eighth glue areas for fixing the collar side tabs (86) to the pack part (11); and e) the glue strips (80, 81), for connecting the pack outer side tabs (23) to the pack inner side tabs (24), and the outer lid side tabs (26) to the inner lid side tabs (25), are respectively coated onto the pack outer side tabs (23) and outer lid side tabs (26) only transversely outside of said middle strip (13**).

2. The process according to claim 1, wherein the glue strips (80, 81) are coated on the blank so that they are parallel to said four spot rows (33, 34, 35, 36) extending in the longitudinal direction of the blank (10).

3. A longitudinally extending blank (10) for producing a hinge-lid pack adapted to receive a cigarette group wrapped in an inner wrapping (82) to form a cigarette block (83); said blank (10) comprising regions limited by folding lines (14) for formation of a pack including a pack part (11) and of a lid (12) flexibly connected thereto: the pack part (11) having a pack front wall (15), a pack rear wall (17), pack inner and outer side tabs (23, 24) that form two-layer pack side walls (87), and a pack bottom wall (16); the lid (12) consisting of a lid front wall (20), a lid top wall (19), and a lid inner tab (22) fastened to the inside of the lid front wall (20); each pack also including a collar (84), consisting of a collar front wall (85) and of collar side tabs (86), which is connected to the pack front wall (15) and to the pack inner side tabs (24) by glue; the blank (10) being coated with a plurality of glue spots (**29*a*–29*i*) and a plurality of glue strips (80, 81**), wherein:

a) the glue spots (**29*a*–29*i*) are arranged on the blank in four parallel spot rows (33, 34, 35, 36) which extend in the longitudinal direction of the blank (10**), and which are transversely spaced apart, so that longitudinally spaced pairs of longitudinally adjacent glue spots respectively define several glue areas;

b) a first pair (34, 35) of said four spot rows is arranged on a middle strip (13) of the blank, said middle strip consisting of the pack front wall (15), the pack bottom wall (16), the pack rear wall (17), the lid rear wall (18), the lid top wall (19), the lid front wall (20) and the lid inner tab (22), in such a way that two pairs of longitudinally adjacent glue spots (**29*c*, 29*d*) coated on the pack rear wall (17), and two pairs of longitudinally adjacent glue spots (29*e*, 29*f*) coated on the pack front wall (15) and facing the pack bottom wall (16), define first and second glue areas, respectively, for fixing the inner wrapping (82) of the cigarette block (83) to the pack, and also in such a way that two pairs of longitudinally spaced glue spots (29***g*, 29*h*), coated on the front wall (15) and facing a free edge thereof, create third and fourth glue areas, respectively, for fixing the collar front wall (85) to the pack part (11), and such that two pairs of longitudinally adjacent glue spots (29*a*, 29*b*), coated on the lid inner tab (22) and on the lid front wall (20), create fifth and sixth glue areas, respectively, for fixing the lid inner tab (22) to the lid front wall (20);

c) a second pair (33, 36) of said four spot rows is coated on the inner pack side tabs (24), respectively, the inner side tabs (24) being located on transversely opposite sides of the middle strip (13), in such a way that two pairs of longitudinally adjacent glue spots (29*i*, 29*j*), coated on the inner side tabs (24), create seventh and eighth glue areas for fixing the collar side tabs (86) to the pack part (11); and d) the glue strips (80, 81), for connecting the pack outer side tabs (23) to the pack inner side tabs (24), and the outer lid side tabs (26) to the inner lid side tabs (25), are respectively located on the pack outer side tabs (23) and outer lid side tabs (26) only transversely outside of said middle strip (13).

* * * * *